United States Patent [19]

Bergler

[11] Patent Number: 4,487,240

[45] Date of Patent: Dec. 11, 1984

[54] BLADE HOLDING MEANS FOR CUTTER SPINDLES OR CUTTER HEADS

[75] Inventor: Otto Bergler, Mühlacker-Lomersheim, Fed. Rep. of Germany

[73] Assignee: Eugen Lutz GmbH & Co Maschinenfabrik, Fed. Rep. of Germany

[21] Appl. No.: 241,730

[22] Filed: Mar. 9, 1981

[30] Foreign Application Priority Data

Mar. 8, 1980 [DE] Fed. Rep. of Germany ... 8006414[U]
Mar. 8, 1980 [DE] Fed. Rep. of Germany ... 8006415[U]

[51] Int. Cl.[3] ..... B27G 13/00

[52] U.S. Cl. ..... 144/230; 407/48; 407/49; 407/99

[58] Field of Search ..... 407/37, 41, 42, 45, 407/48, 49, 61, 62, 108, 99; 144/230; 83/674, 677, 698, 699, 700

[56] References Cited

U.S. PATENT DOCUMENTS

| | | | |
|---|---|---|---|
| 2,598,933 | 6/1952 | Nevin | 144/230 |
| 2,755,830 | 7/1956 | Utz | 144/230 |
| 3,791,429 | 2/1974 | Morris | 407/49 |
| 3,854,511 | 12/1974 | Maier | 144/230 |
| 4,082,128 | 4/1978 | Barke et al. | 144/230 |
| 4,194,545 | 3/1980 | Kostermeier | 144/174 |
| 4,257,462 | 3/1981 | Oller | 144/230 |
| 4,305,440 | 12/1981 | Lacasse | 144/230 |
| 4,349,057 | 9/1982 | Bachman et al. | 144/230 |

FOREIGN PATENT DOCUMENTS

| | | | |
|---|---|---|---|
| 753907 | 3/1967 | Canada | 144/230 |
| 1273168 | 7/1968 | Fed. Rep. of Germany | 144/230 |
| 2751903 | 5/1972 | Fed. Rep. of Germany | 144/230 |
| 314806 | 4/1974 | Fed. Rep. of Germany | 144/230 |
| 7602409 | 1/1976 | Fed. Rep. of Germany | 144/230 |
| 2736612 | 12/1979 | Fed. Rep. of Germany | 144/230 |

*Primary Examiner*—Leonidas Vlachos
*Assistant Examiner*—Jerry Kearns
*Attorney, Agent, or Firm*—Craig and Burns

[57] ABSTRACT

A blade holding arrangement for cutter spindles or cutter heads which are adapted to be equipped with reversible blades. The arrangement including radially adjustable blade holders in the form of drawn profile sections, with the blades adapted to be pressed against guide shoulders of the cutter spindles or cutter heads. The blade holders are provided with a reinforcing elevation or projection that slopes downward in a direction of the guide shoulders. A groove, extending in parallel to the reinforcing elevation or projection, is provided in the blade holder adjacent the reinforcing elevation or projection on a radially inner side of the blade holder.

9 Claims, 4 Drawing Figures

BLADE HOLDING MEANS FOR CUTTER SPINDLES OR CUTTER HEADS

The present invention relates to a holding means and, more particularly, to a blade holding means for spindles or cutter heads equipped with reversible blades, the blade holding means being radially adjustable and being fashioned from drawn profile sections and being adapted to be pressed or urged against guide shoulders of the cutting heads or spindles, with a reinforcing projection or elevation being provided on the blade holder means which slopes in a direction of the guide shoulders.

Blade holding means of the aforementioned type have been proposed in, for example, German Offenlegungsschrift No 27 51 903, wherein drawn profile sections are provided as pressure pieces and blade holders which are directly provided with bores for accommodating fasteners adjustable in an approximately circumferential direction. The blade holder means may be readily adjustable so that upon a fastening of the fasteners, a radial adjustment of a position of the cutting blades and a locking in a circumferential direction can be effected. For this purpose, the blade holders are pressed against the blades and against the guide shoulders in the cutting heads with the reinforcing elevation or projection that slopes down against the guide shoulder contributing to a prevention of excessive deformation of the blade holders and pressure pieces since the reinforcing elevation or projection itself rests against the guide shoulders. With the proposed blade holding means, only small reversible blades can be inserted and, when larger cutting blades are required such as, for example, profiled cutting blades, a special adjustment must be made and special pressure pieces must be manufactured.

The aim underlying the present invention essentially resides in providing a holding means of the aforementioned type which enables the holding or mounting of small reversible blades as well as large cutting blades by means of the utilization of the same pressure piece.

In accordance with advantageous features of the present invention, a groove, extending in parallel to the reinforcing elevation or projection, is provided in the blade holder on a radially inner side of the reinforcing elevation or projection thereby enabling the advantageous development of profile pieces which may be used for inserting small reversible blades by inserting a guide rib of a holding plate into the groove, which holding plate is interposed between the guide shoulder and the bridge and therefore bridges a distance between the blade holder and guide holder that must be maintained when a large cutting plate is inserted. The holding blade may, in accordance with the present invention, be equipped with another guide rib that engages in a groove of the reversible blade.

However, it is also possible to directly insert a larger cutting blade in the holding means. For this purpose, contact surfaces for the blade are disposed at a radially inner side of the groove as well as on a radially outer side of the reinforcing elevation or projection of the blade holder. The blade may be guided along the contact surfaces with a further groove being provided onto the reinforcing elevation or projection.

With a blade holder and profile piece constructed in accordance with the present invention, the reinforcing elevation or projection does not serve, as in previously proposed constructions, as a reinforcement or a stop for limiting a bending or deformation but rather serves for directly taking over a radial guidance of a larger cutting blade where, on both sides, it changes into guide surfaces for the cutting blade. For an insertion or accommodation of small reversible blade in the blade holder of the present invention, one side of the reinforcing elevation or projection at the same time forms a wall for a groove in which the holding plate for the reversible blade is accommodated.

Advantageously, in accordance with further features of the profile pieces and blade holders of the present invention, axial grooves are provided for accommodating holding bars of a cutting depth limiting means which may be attached, in a form locking manner and which may be die-cast on the blade holder in an especially simple manner so as to enable the profile pieces and blade holders of the present invention to readily accommodate large cutting blades, especially blades with a profiling.

In accordance with further advantageous features of the present invention, the blade holding means may be inserted into recesses at a circumference of a cylindrical cutter head which is fashioned as a drawn hollow section having two hollow chambers that extend in a longitudinal direction, with the two hollow chambers being separated by an intermediate bar as well as a central opening for receiving a driving shaft. The cylindrical cutting head may be provided with diametrically opposite recesses for accommodating the cutting blades. The cylindrical cutter head, drawn as a hollow section, may be manufactured so as to be of a substantial axial length which may be subsequently cut to desired lengths.

By virtue of the above noted features of the present invention, it is possible to manufacture a cutter head only from a drawn profile such as, for example, an extrusion profile made of, for example, aluminum. Not only does the manufacturing of the cutter head in accordance with the present invention eliminate the subsequent expensive working of the head, but also the hollow section may be stored by the meter, with the cutter heads then only being cut to length from the profile section. Thus, the manufacturing costs for a cutter head are considerably lower.

For reasons of stability, previously proposed cutter heads have been generally made from solid material. A disadvantage of such proposed cutter heads resides in the fact that not only do the cutter heads have a relatively high weight but also a relatively high moment of inertia thereby resulting in considerable stresses to the driving motors and to a possible drive unit when the relatively large masses must be frequently accelerated or slowed down. In this connection, it must be taken into account that cutter heads of this type are often operated at speeds between 15,000 to 20,000 revolutions per minute. A further disadvantage of these proposed cutter heads resides in the fact that the constructional features are relatively complex or complicated so that high manufacturing expenses are incurred in subsequent working of the cutter heads as well as considerable expenditures are necessary for the material of the cutter head. Since the present invention proposes providing a cutter head fashioned from drawn hollow sections, the weight may be reduced considerably so that the above noted disadvantages of previously proposed cutter heads are eliminated.

In accordance with the present invention, it is practical to provide in each case, in an area of outside walls of the continuous hollow sections of the cutter head, diametrically opposite ribs that may be easily drilled into from the outside thereby enabling a balancing of a finished cutter head. It is also advantageous if an intermediate bar, at its center, is provided with an opening for receiving the driving shaft and, at its two ends, is expanded in a fork-shaped manner, into recesses for accommodating the cutting blades, in which case the two branches of each fork-shaped extended portion change into circular outside walls of the hollow chambers and thus assume the configuration of the basic body of the cutter head.

By virtue of the construction of a profile or section for a cutter head in accordance with the present invention, despite the light weight, the cutter head is nevertheless very sturdy and can readily meet the requirements expected of a cutter head. The cutter head of the present invention, coupled with the new blade holding means, results in an especially simple and effective tool.

Accordingly, it is an object of the present invention to provide a blade holding means for cutter spindles or cutter heads as well as a cutter head construction which avoids, by simple means, shortcomings and disadvantages encountered in the prior art.

Another object of the present invention resides in providing a blade holding means for cutter spindles or cutter heads which accommodates both large cutting blades and small reversible blades without the need of special adjustments or additional mounting pieces.

Another object of the present invention resides in providing a blade holding means for cutter spindles or cutter heads which is simple in construction and therefore relatively inexpensive to manufacture.

A still further object of the present invention resides in providing a cutter head which is simple in construction, light weight, and yet is of sufficient strength so as to meet all the normal requirements of the cutter head in practical use.

These and other objects, features, and advantages of the present invention will become more apparent from the following description when taken in connection with the accompanying drawings which show, for the purpose of illustration only, several embodiments in accordance with the present invention, and wherein.

Figure 1:
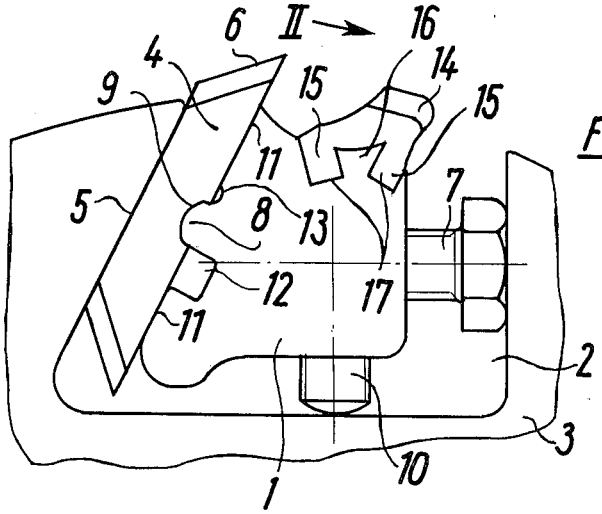
FIG. 1 is a partially schematic side view of a portion of a cutter head in an area of insertion point of a profiled cutting blade with a holding means constructed in accordance with the present invention.
Figure 2:
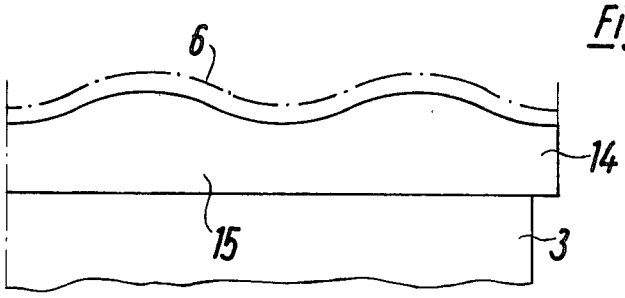
FIG. 2 is a partial schematic view of a cutting depth limiting means of FIG. 1 taken approximately in a circumferential direction of the arrow II in FIG. 1.

Referring now to the drawings where like reference numerals are used throughout the various views to designate like parts and, more particularly, to FIGS. 1 and 2, according to these figures, a blade holder 1, manufactures a drawn profile or drawn section from, for example, a special metal alloy, is accommodated in a recess 2 of a cutter head 3 with the blade holder 1 serving for holding a cutting blade 4 which is pressed against a guide shoulder 5 that extends diagonally in a radial direction. As shown in phantom line in FIG. 2, an outside contour 6 of the cutting blade is corrugated or undulated so that, for example, in woodworking, a cutting may be carried out so as to leave a special design on a surface of the workpiece. The cutting blade 4 is pressed against the guide shoulder 5 since the blade holder 1 is acted on by an adjusting or pressing screw 7 interposed between a wall of the recess 2 and the blade holder 1. Screw 7 presses the blade holder 1 and cutting blade 4 against the guide shoulder 5.

A reinforcing elevation or projection 8 is provided for enabling a radial adjustment of the position of the cutting blade 4. The projection or elevation 8 first extends in an axial direction of the cutter head 3 and engages in a corresponding groove 9 provided in the cutting blade 4. A radially extending adjusting screw 10 is provided for adjusting a position of the cutting edge 6 of the blade 4 as long as the screw 7 is disengaged. When the adjustment of the adjusting screw 10 has been completed, the screw 7 is tightened and the position of the cutting blade 4 is fixed. In order to insure a perfect position in order to press the whole rear surface of the cutting blade 4 against the guide shoulder 5, contact surfaces 11, which extend in parallel to the guide shoulder 5, are provided on both sides of the reinforcing elevation or projection 8. A groove 12, the function of which will be described more fully hereinbelow, is disposed adjacent the elevation or projection on a radially inner side of the blade holder 1. A smaller groove 13, is utilized for among other things, separating the radially inside contact surface 11 in a perfect manner from the projection or elevation 8. Groove 13, as shown in FIG. 1, is disposed adjacent the projection or elevation 8 on a radially outer side of the blade holder 1.

A cutting depth limiting means 14 is, in a form-locking manner, accommodated on the blade holder 1. The cutting depth limiting means 14 includes two outside holding bars 15 between which is defined a dovetailed recess for accommodating a dovetailed bar 16. The dovetailed bar 16 is formed in the blade holder 1 in such a way that either subsequently or at the time of drawing of the profile of the blade holder 1, the grooves 17 for accommodating the holding bars 15 are also drawn in.

Figure 3:
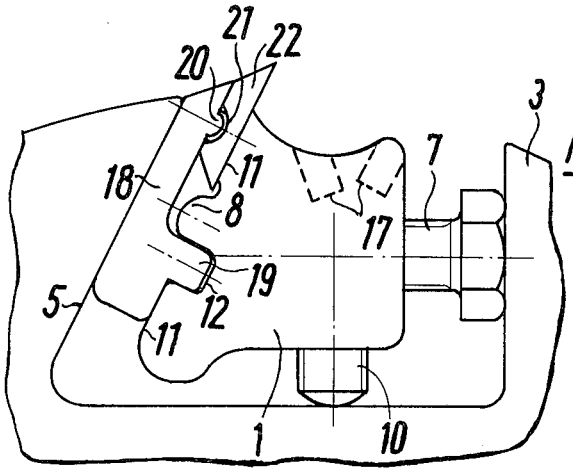
FIG. 3 is a partially schematic lateral view of the blade holder of FIG. 1 accommodating a reversible blade.

As shown in FIG. 3, a holding plate 18 is associated with the blade holder 1 of FIG. 1, and in such a situation, the blade holder 1 does not necessarily have to be equipped with grooves 17. The holding plate 18 is provided with a guide rib 19 which is adapted to engage in the groove 12 so as to radially guide the holding plate 18. The holding plate 18 is provided with another guide rib 20 which engages in a semicircular groove 21 of a small reversible blade 22. The small reversible blade 22 is inserted between the contact surface 11 of the blade holder 1 and the holding plate 18.

A radial adjustment of the construction of FIG. 3 is effected in the same manner as described hereinabove in connection with the construction of FIG. 1. As can readily be appreciated, with a blade holder 1 constructed in accordance with the present invention, the blade holder 1 may be utilized for two different holding processes and it is only necessary to provide one holding plate 18 when small reversible blades 22 are to be held or mounted in the blade holder 1. Therefore, the present invention has the advantage that universally usable blade holders in the form of drawn profiles may be provided.

Figure 4:
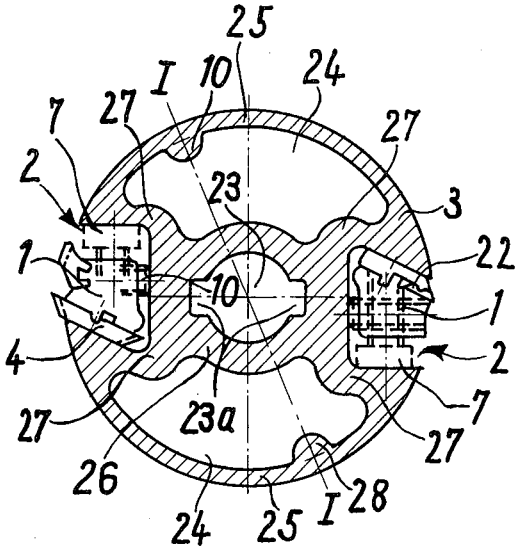
FIG. 4 is a cross-sectional view of a cutter head constructed in accordance with the present invention which is adapted to accommodate the blade holding means of FIGS. 1 through 3.

FIG. 4 provides an example of a basic body of a cutter head 3 constructed in accordance with the present invention and fashioned as a hollow section that essentially has a cross-section composed of two semicircular cross-sections which are identical to each other but are inverted with respect to the sides along a line I—I. The extrusion formed in the cutter head 3 is formed in such a way that a central continuous opening 23 is provided which includes two lateral grooves 23*a*, with a driving shaft being adapted to be accommodated in the opening 23 and the lateral grooves 23*a* so that the cutter head 3 rotates with the driving shaft. The inside opening 23 has two diametrically disposed hollow chambers 24 having outside walls 25 which form an outer circumference of the basic body of the cutter head 3. Both of the hollow chambers 24 are separated from each other by a transversely extended bar 26 in which is formed the central opening 23. The transversely extended bar 26 at its two outer ends terminates in a fork-shaped opening formed by two branches 27 which extend to the outside walls 25. The longitudinally extending recesses of the cutter head 3 are defined between the fork-shaped branches 27, with the recesses being adapted to accommodate the adjustable blade holding means 1 having exchangeable reversible blades 4 or similar devices. In the illustrated embodiment of FIG. 4, the two possible constructions of the blade holding means of the present invention are illustrated as being accommodated in the respective recesses 2 of the cutter head 3, namely, the blade holding means 1 accommodating a blade 4 and a reversible small blade 22, with the left hand portion of the cutter head illustrating holding means 1 holding profiled blades 4 of FIG. 1 and the right hand portion of FIG. 4 illustrating the mounting of reversible blades 22 of FIG. 3.

Ribs 28 having semicircular cross-sections are provided in an area of the outside walls 25 of both hollow chambers 24. The ribs 28 are located diametrically to the axis of the whole basic body forming the cutter head 3 and, with a finished cutter head, may be utilized to permit a balancing process for the cutter head 3 by drilling or similar processes. The new extrusion profile forming the cutter head 3 may, for example, be fashioned from aluminum thereby being advantageous in that the material is very light and there is considerably savings with respect to material due to the arrangement of the hollow chambers 24.

By virtue of the construction of a cutter head 3 of an extruded hollow section, the cutter heads 3 may be formed by cutting the extruded profile in predetermined widths for desired cutter heads with the so cut widths then being used, possibly after a deburring, for a final finishing.

The extrusion profiles or sections in accordance with the present invention, as constructed as multi-chambered profiles or sections, are produced in such a way that the two sections or profile halves, for example, divided along the line I—I in FIG. 4, are separately extruded through dies and immediately therefter loaded through a third die and are thus welded together into the round section.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A blade holding means for a cutter head having a rotating axis and having a reversible blade, comprisinga radially adjustable blade holder, in the shape of drawn profile sections, means for radially adjusting the blade holder with respect to the axis, and means to move the blade holder laterally to secure a blade to the cutter head, two spaced apart blade supporting surfaces on said blade holder, a reinforcement projection on the blade holder projecting beyond said blade supporting surfaces for locating a blade, a groove between said blade supporting surfaces adjacent to the reinforcement projection that is radially closer to the axis than the projection and parallel to said axis for receiving means to position a smaller blade wherein either (a) a holding plate means having a guide which is inserted into the groove, a second guide rib on the holding plate means for locating a small cutting blade on one of said supporting surfaces, or (b) a large cutting blade having a recess which engages the reinforcement projection said large cutting blade engaging the spaced apart blade supporting surfaces, one located radially closer to the axis with respect to the groove and the second radially more remote from the axis with respect to the reinforcement projection.

2. A blade holding means according to claim 1, wherein said blade holder is provided with grooves parallel to said cutter head axis and retaining bar means for limiting cutting-depths, including form-locking means in engagement with said grooves.

3. A blade holding means according to claim 1, wherein the small cutting blade has a locating groove for receiving said holding plate second guide rib, the small cutting blade engaging at least a contact surface and a holding plate engaging the guide shoulder and at least a contact surface, the holding plate comprising a guide rib engaging the blade shoulder in the first groove.

4. A blade holding means according to any one of claims 1 or 2, wherein the cutter head is a drawn hollow section of a substantially cylindrical cross-section and includes a pair of recesses for respectively accommodating a pair of the cutting blade holding means, two longitudinally extending hollow chambers, an intermediate bar portion separating the two hollow chambers, and a central opening for accommodating a drive shaft means for the cutter head.

5. A blade holding means according to claim 4, wherein the pair of recesses are disposed at diametrically opposite positions.

6. A blade holding means according to claim 5, wherein each of the hollow chambers includes wall portions defining an outer circumferential surface of the cutter head, and means at the wall portions for enabling a balancing of the cutter head.

7. A blade holding means according to claim 6, wherein the means for enabling a balancing of the cutter head includes at least a pair of diametrically oppositely disposed rib means.

8. A blade holding means according to claim 6, wherein respective ends of the intermediate bar portion terminate in forked portions defining the respective pair of recesses for accommodating the cutting blade holder.

9. A blade holding means according to claim 8, wherein each of the forked portions merge into an outer wall defining the outer circumferential surface of the cutter head.

* * * * *